US009358793B2

(12) United States Patent
Arimizu et al.

(10) Patent No.: US 9,358,793 B2
(45) Date of Patent: Jun. 7, 2016

(54) LIQUID EJECTION APPARATUS AND LIQUID EJECTION METHOD

(71) Applicant: CANON KABUSHIKI KAISHA, Tokyo (JP)

(72) Inventors: Hiroshi Arimizu, Kawasaki (JP); Masahiko Kubota, Tokyo (JP); Nobuhito Yamaguchi, Inagi (JP); Yusuke Imahashi, Kawasaki (JP); Arihito Miyakoshi, Tokyo (JP); Yoshinori Itoh, Tokyo (JP); Koichi Ishida, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/642,900

(22) Filed: Mar. 10, 2015

(65) Prior Publication Data

US 2015/0273835 A1 Oct. 1, 2015

(30) Foreign Application Priority Data

Mar. 25, 2014 (JP) ..... 2014-062313
Dec. 25, 2014 (JP) ..... 2014-262526

(51) Int. Cl.
*B41J 2/17* (2006.01)
*B41J 2/165* (2006.01)

(52) U.S. Cl.
CPC ..... *B41J 2/1714* (2013.01); *B41J 2/16585* (2013.01); *B41J 2002/16591* (2013.01)

(58) Field of Classification Search
CPC ..... B41J 2/185; B41J 2/1714; B41J 2/215; B41J 2/16523; B41J 2/16532; B41J 2/16517; B41J 2002/1853; B41J 2/165
USPC ..... 347/30, 34
See application file for complete search history.

(56) References Cited

U.S. PATENT DOCUMENTS

| | | | | |
|---|---|---|---|---|
| 6,945,627 | B2 | 9/2005 | Yamaguchi | |
| 7,314,267 | B2 | 1/2008 | Yamaguchi et al. | |
| 8,262,192 | B2 * | 9/2012 | Matsumoto | 347/25 |
| 8,356,881 | B2 | 1/2013 | Ohnishi | |
| 2006/0239751 | A1 * | 10/2006 | Krauskopf et al. | 400/659 |
| 2007/0109348 | A1 * | 5/2007 | Izawa et al. | 347/34 |

(Continued)

FOREIGN PATENT DOCUMENTS

| | | | |
|---|---|---|---|
| JP | 2004090533 A | * | 3/2004 |
| JP | 2010-137483 A | | 6/2010 |

OTHER PUBLICATIONS

Kawai, MachineTranslationofJP2004-090533A, Mar. 25, 2004.*

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

The present invention suppresses the spread of a mist of a liquid ejected from a liquid ejection head. Air is blown out toward a printing medium from a blowing-out opening relatively moving together with a print head, as the liquid ejection head, with respect to the printing medium. Air on the printing medium is sucked into a suction opening relatively moving together with the print head with respect to the printing medium. An ink ejection opening of the print head, the blowing-out opening, and the suction opening are arranged in the order from an upstream side to a downstream side in a moving direction of the printing medium with respect to the print head.

11 Claims, 11 Drawing Sheets

(56) References Cited

U.S. PATENT DOCUMENTS

2010/0021219 A1* 1/2010 Hori ..... 399/388
2013/0180245 A1* 7/2013 Saddoughi et al. ..... 60/697
2015/0085014 A1 3/2015 Ishida et al.

* cited by examiner

LIQUID EJECTION APPARATUS AND LIQUID EJECTION METHOD

BACKGROUND OF THE INVENTION

1. Field of the Invention

The present invention relates to a liquid ejection apparatus and a liquid ejection method for ejecting a liquid such as an ink from a liquid ejection head.

2. Description of the Related Art

An inkjet printing apparatus as a liquid ejection apparatus, for example, may produce minute ink droplets as an ink mist as well as ink droplets which are to land on a printing medium (a medium) when ejecting an ink (a liquid) from a print head (a liquid ejection head). This ink mist may land on the print head, causing an ink ejection failure or staining the inside of the printing apparatus.

Japanese Patent Laid-Open No. 2010-137483 discloses a printing apparatus comprising an air blowing-out opening and an air suction opening between which nozzles of the print head are sandwiched in order to collect the above ink mist. The ink mist is collected through the suction opening by sucking together with air blown out from the blowing-out opening.

However, in the printing apparatus disclosed in Japanese Patent Laid-Open No. 2010-137483, a gas flow generated between the blowing-out opening and the suction opening passes through the positions of the nozzles. The gas flow may cause ink droplets ejected from the nozzles to land on a printing medium at deviated positions, thus lowering the printing quality of an image. Further, in a case where the flow rate of the gas flow between the blowing-out opening and the suction opening is low, it is difficult to collect the ink mist.

SUMMARY OF THE INVENTION

The present invention provides a liquid ejection apparatus and a liquid ejection method capable of suppressing the spatter of a liquid mist ejected from a liquid ejection head.

In a first aspect of the present invention, there is provided a liquid ejection apparatus for ejecting a liquid to a medium while a liquid ejection head capable of ejecting the liquid from an ejection opening and the medium relatively move with respect to each other, the liquid ejection apparatus comprising:

a blowing-out unit including a blowing-out opening for blowing out gas toward the medium and relatively moving together with the liquid ejection head with respect to the medium; and a suction unit including a suction opening for sucking gas on the medium and relatively moving together with the liquid ejection head with respect to the medium, wherein the ejection opening, the blowing-out opening, and the suction opening are arranged in order from an upstream side to a downstream side in a movement direction of the medium with respect to the liquid ejection head.

In a second aspect of the present invention, there is provided a liquid ejection method for ejecting a liquid to a medium from an ejection opening of a liquid ejection head while the liquid ejection head and the medium relatively move with respective to each other, the liquid ejection method comprising the steps of:

preparing a blowing-out unit including a blowing-out opening for blowing out gas toward the medium and a suction unit including a suction opening for sucking gas on the medium, the blowing-out unit and the suction unit relatively moving together with the liquid ejection head with respect to the medium; and ejecting the liquid from the ejection opening toward the medium, blowing out gas from the blowing-out opening, and sucking, into the suction opening, gas on the medium including the gas blown out from the blowing-out opening, wherein the liquid ejected from the ejection opening includes a main droplet and a mist, and at least a portion of the mist moves toward the medium together with the gas blown out from the blowing-out opening and lands on the medium.

The present invention can suppress the spatter of a liquid mist by specifying positional relationships among the liquid ejection opening, the blowing-out opening for blowing out gas, and the suction opening for sucking gas in the liquid ejection head to cause a liquid mist ejected from the liquid ejection head to land on the medium. As a result, the present invention can suppress the lowering of image quality and the staining of the inside of the printing apparatus as the liquid ejection apparatus, for example, which are caused by the spatter of an ink mist. Further, it becomes unnecessary to collect an ink mist and dispose of the collected ink mist, and it becomes possible to miniaturize the printing apparatus as a whole.

Further features of the present invention will become apparent from the following description of exemplary embodiments (with reference to the attached drawings).

DESCRIPTION OF THE EMBODIMENTS

Embodiments of the present invention will be described below with reference to the drawings.

First Embodiment

Figure 1:
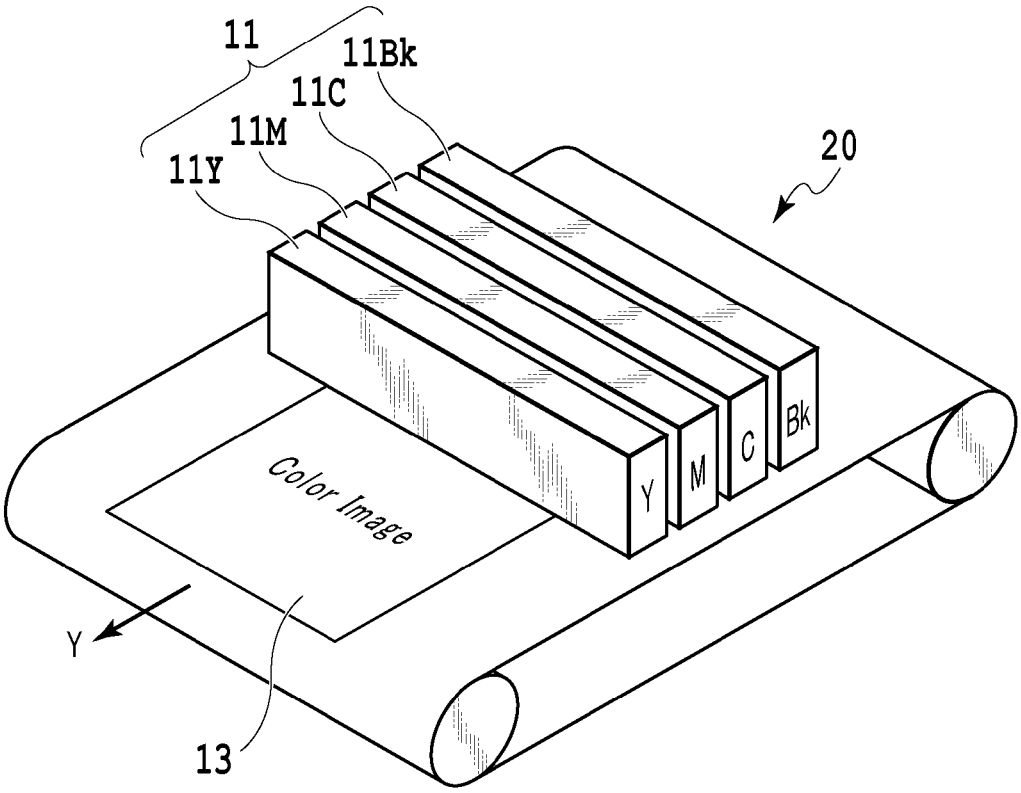
FIG. 1 is a schematic structural view of a printing apparatus of a first embodiment of the present invention.

FIG. 1 is a schematic structural view of an inkjet printing apparatus as a liquid ejection apparatus of the present embodiment. The printing apparatus in this example is a printing apparatus constituting a so-called full-line type commercial printing apparatus. This printing apparatus uses, as a liquid ejection head (a print head) 11 for ejecting a liquid such as an ink, a long liquid ejection head (a line head) extending across the entire width of a printing area of a printing medium (a medium) 13. In this example, a liquid ejection head 11Y for ejecting a yellow ink, a liquid ejection head 11M for ejecting a magenta ink, a liquid ejection head 11C for ejecting a cyan ink, and a liquid ejection head 11Bk for ejecting a black ink are provided as the liquid ejection head 11. The printing medium 13 is conveyed in a direction of an arrow Y by a conveying mechanism 20 using a conveying belt, a conveying roller, and the like. In the liquid ejection head 11, a plurality of nozzles capable of ejecting an ink are formed and arranged to form nozzle arrays extending in a direction intersecting (in the present embodiment, perpendicularly intersecting) with the conveying direction of the arrow Y. The nozzles eject an ink by using ejection energy generating elements such as electrothermal transducing elements (heaters) or piezo elements. In a case where the electrothermal transducing elements are used, an ink is bubbled by generating heat with the electrothermal transducing elements and the bubble energy is used to eject an ink from ejection openings in the ends of the nozzles.

At the time of printing an image, an ink is ejected from the liquid ejection head 11 while the printing medium 13 is continuously conveyed in the direction of the arrow Y. The liquid ejection head 11 and the printing medium 13 only need to be relatively moved, and the liquid ejection head 11 may be moved with respect to the printing medium 13.

Figure 2A:
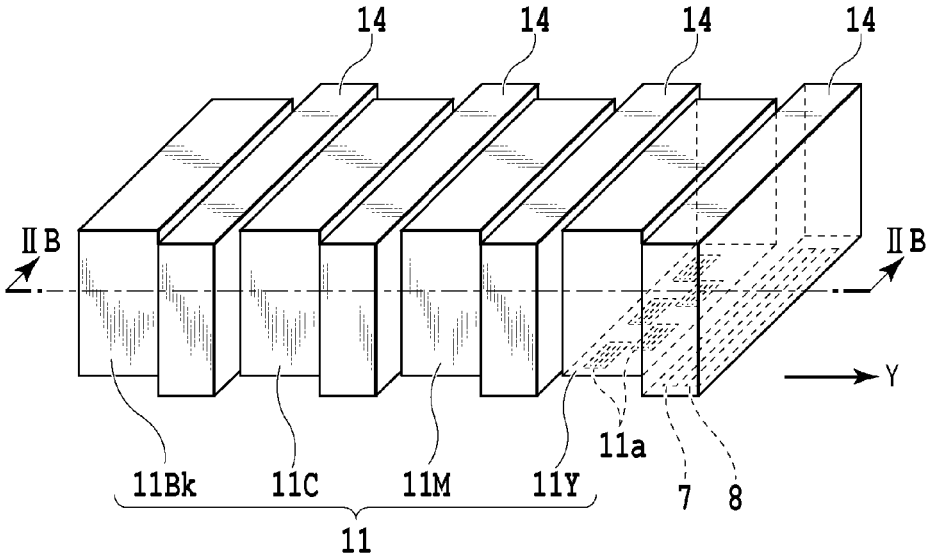
FIG. 2A is a perspective view of a liquid ejection head section in FIG. 1
Figure 2B:
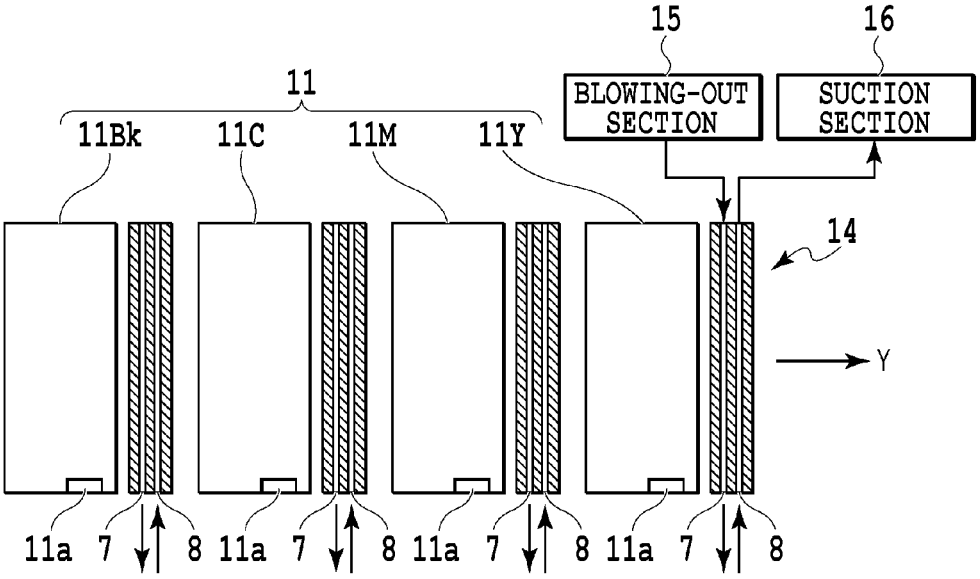
FIG. 2B is a cross-sectional view taken along the line IIB-IIB in FIG. 2A.
Figure 3:
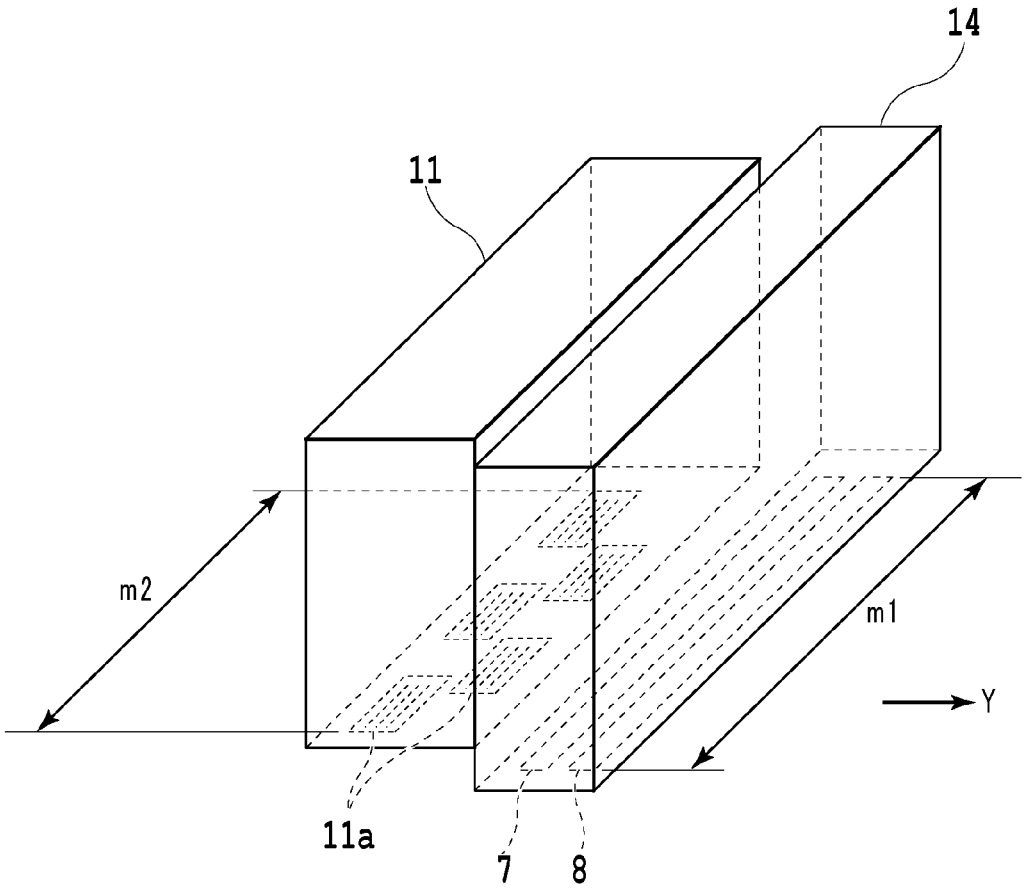
FIG. 3 is an enlarged perspective view of the liquid ejection head section in FIG. 2A.

For each liquid ejection head 11, a gas blowing-out/suction mechanism 14 positioned downstream in the conveying direction (the direction of the arrow Y) is provided, as shown in FIGS. 2A and 2B. The mechanism 14 includes a blowing-out opening 7 communicating with a blowing-out section 15 for blowing out gas including air and various gases and a suction opening 8 communicating with a suction section 16 for sucking gas including air and various gases. The blowing-out opening 7 blows out, on the printing medium 13, gas supplied from the blowing-out section 15, and the suction opening 8 sucks the gas on the printing medium 13 by using suction force generated by the suction section 16. The liquid ejection head 11, the blowing-out opening 7, and the suction opening 8 are arranged along the conveying direction (the direction of the arrow Y) in the order named. More specifically, the liquid ejection head 11, the blowing-out opening 7, and the suction opening 8 are arranged in the order named in a direction of relative movement of the printing medium 13 and the liquid ejection head 11. In this manner, the suction mechanism 14 is prepared which relatively moves together with the liquid ejection head 11 with respect to the printing medium 13. In FIG. 3, it is desirable that m1>m2 where m1 is the width of the blowing-out opening 7 and the suction opening 8 in a direction intersecting (in the present embodiment, perpendicularly intersecting) with the conveying direction of the printing medium 13 (the direction of the arrow Y) and m2 is the width of the nozzle arrays in the direction intersecting (in the present embodiment, perpendicularly intersecting) with the conveying direction. Further, in the liquid ejection head 11 in this example, a plurality of head chips 11*a* in which the plurality of nozzle arrays are formed are arranged in a zigzag pattern. These nozzle arrays may eject different inks or may eject the same ink.

Figure 4:
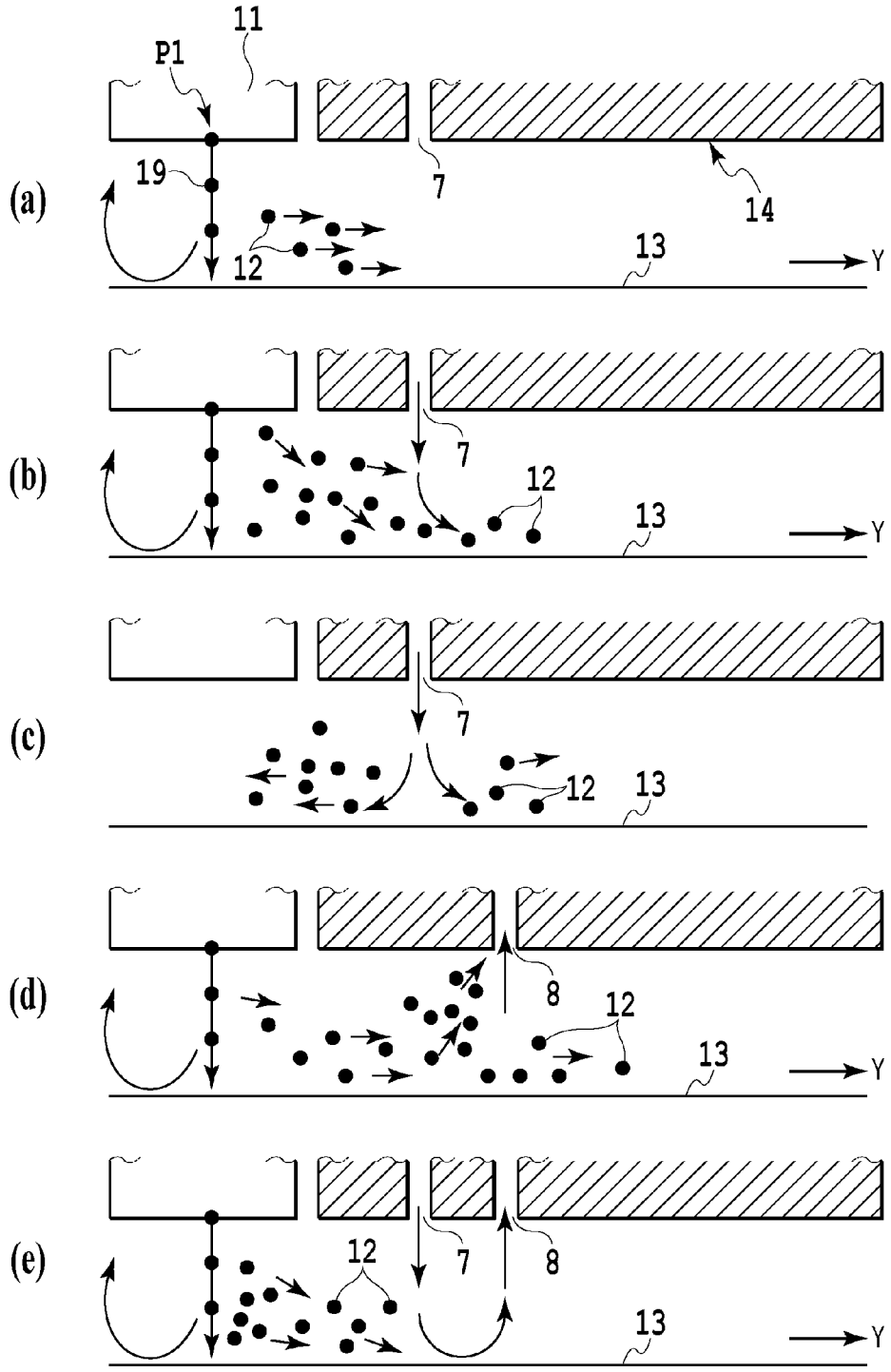
FIG. 4 is an explanatory view for explaining a relationship between an ink mist and a gas flow and includes portions (a) to (e)

FIG. 4 is an explanatory view for explaining a relationship between a gas flow generated by the relative movement of the liquid ejection head 11 and the printing medium 13 and an ink mist 12 generated by ejecting ink droplets 19 (main droplets) from a nozzle position P1 of the liquid ejection head 11.

The ink mist (hereinafter also simply referred to as "the mist") 12 generated by ejecting the ink droplets from the liquid ejection head 11 flows toward a downstream side in the conveying direction of the arrow Y because of the gas flow generated by the relative movement of the liquid ejection head 11 and the printing medium 13 as shown in the portion (a) of FIG. 4. In a case where gas is blown out from the blowing-out opening 7 of the gas blowing-out/suction mechanism 14 as shown in the portion (b) of FIG. 4, the mist 12 flows into the periphery of the surface of the printing medium 13 because of the flow of the gas blown out from the blowing-out opening 7. Most of the mist 12 can be caused to land on the printing medium 13 by setting the flow rate of the gas blown out from the blowing-out opening 7. However, part of the mist 12 may flow toward the downstream side in the conveying direction of the arrow Y.

In a case where the relative movement of the liquid ejection head 11 and the printing medium 13 stop after the ejection of the ink droplets 19 from the liquid ejection head 11 is completed, no gas flow is generated between the liquid ejection head 11 and the printing medium 13. Accordingly, as shown in the portion (c) of FIG. 4, part of the mist 12 which was generated by performing the printing operation before lands on the printing medium 13 because of the flow of the gas blown out from the blowing-out opening 7, but most of the mist 12 spatters around the periphery. As shown in the portion (d) of FIG. 4, the mist 12 can be collected by sucking, into the suction opening 8, air between the liquid ejection head 11 and the printing medium 13. However, force for sucking air from the blowing-out opening 7 may affect the ink droplets 19 ejected from the nozzle position P1 in the liquid ejection head 11 to deviate the ejection direction of the ink droplets, thus lowering the printing quality of an image. Further, in a case where the amount of air sucked into the suction opening 8 is small, the mist 12 may flow toward the downstream side in the conveying direction of the arrow Y.

In consideration of the relationship between the mist 12 and the gas flow as shown in the portions (a) to (d) of FIG. 4, in the present embodiment, the liquid ejection head 11, the blowing-out opening 7, and the suction opening 8 are arranged as shown in the portion (e) of FIG. 4. More specifically, the ejection opening in the end of the nozzle of the liquid ejection head 11, the blowing-out opening 7, and the suction opening 8 are arranged in the order from the upstream side to the downstream side in the conveying direction of the arrow Y. Accordingly, the ink mist 12 generated by ejecting the ink droplets 19 from the position P1 of the ejection opening of the liquid ejection head 11 flows toward the printing medium 13 because of the gas blown out from the blowing-out opening 7. Then, the ink mist 12 lands on an area of the printing medium 13 between the liquid ejection head 11 and the suction opening 8 in the directions of the relative movement of the liquid ejection head 11 and the printing medium 13 when viewing the printing medium 13 from a vertical direction. The gas blown out from the blowing-out opening 7 forms a stable gas flow toward the printing medium 13 as shown in the portion (e) of FIG. 4 because gas is sucked into the suction opening 8. Even in a case where the gas flow between the liquid ejection head 11 and the printing medium 13 changes because of a change in printing state such as a change at the time of starting printing, a change at the time of finishing printing, or a sudden change in printing density, the mist 12 can stably land on the surface of the printing medium 13. More specifically, a combination of blowing out gas from the blowing-out opening 7 and sucking gas into the suction opening 8 can stably form a gas flow toward the printing medium 13 so that the mist 12 can land on the surface of the printing medium 13.

The efficiency of collecting the mist 12 varies depending on a distance L between the gas blowing-out opening 7 and the suction opening 8 (see FIG. 5), the amount of gas blown out from the blowing-out opening 7 per unit time, and the amount of gas sucked into the suction opening 8 per unit time. A change in collection of the mist 12 is simulated by using, as parameters, the distance L, the amount of the gas blown out from the blowing-out opening 7, the amount of the gas sucked into the suction opening 8, and the like. As a result, it is understood how the distance L such that the mist 12 can stably land on the printing medium 13 relates to a distance h between the gas blowing-out/suction mechanism 14 and the printing medium 13. In this simulation, the distance h is set at 1.0 mm, the widths m1 and m2 (see FIG. 3) are both set at 0.5 mm, and the conveying speed of the printing medium 13 is set at 0.635 m/s. In this example, the distance h is equal to a distance between the liquid ejection head 11 and the printing medium 13. The distance h may be shorter or longer than the distance between the liquid ejection head 11 and the printing medium 13.

Figure 5:
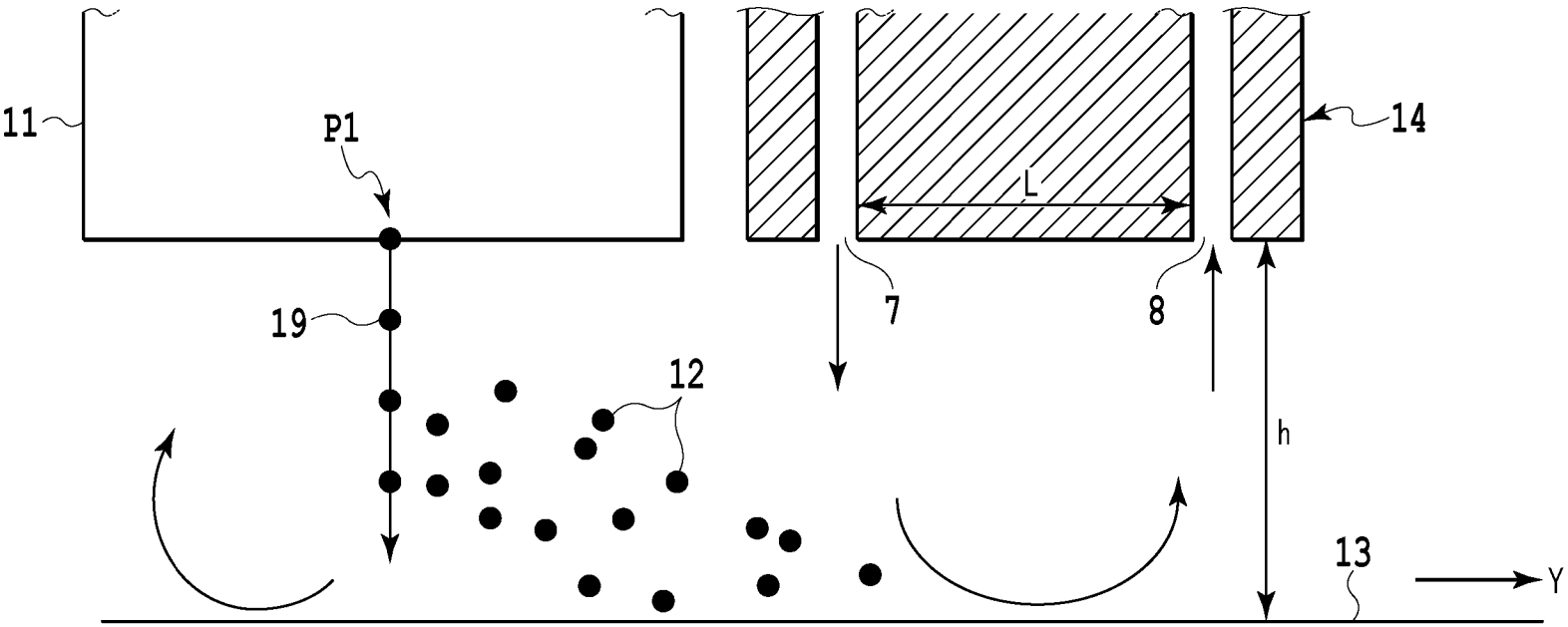
FIG. 5 is an explanatory view for explaining a relationship between an ink mist and a gas flow in the first embodiment of the present invention.
Figure 6A:
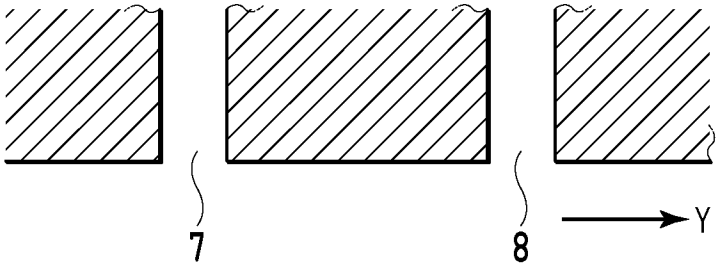
FIGS. 6A, 6B, 6C, and 6D are cross-sectional views for explaining different variations of a blowing-out opening and a suction opening as a second embodiment of the present invention.
Figure 6B:
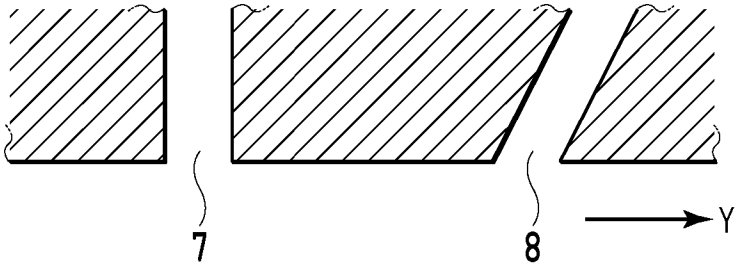
Figure 6C:
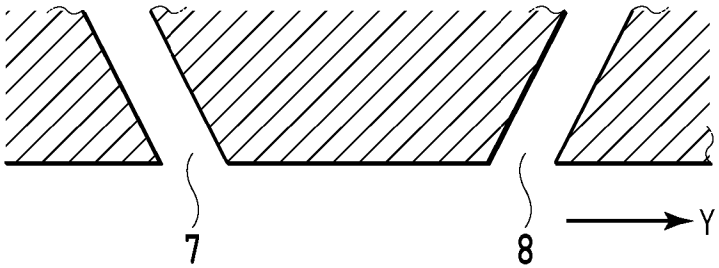
Figure 6D:
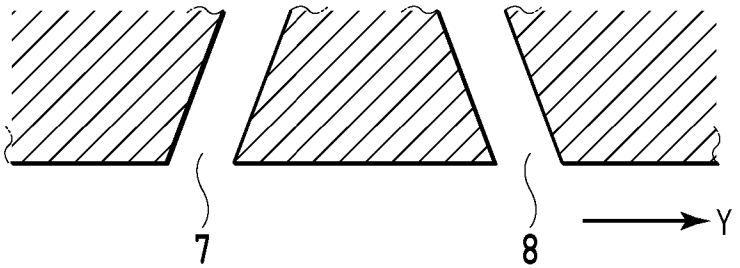

Since the blowing-out of gas from the blowing-out opening 7 and the suction of gas into the suction opening 8 are performed simultaneously, a stable gas flow is generated between the blowing-out opening 7 and the suction opening 8 as shown in FIG. 5. In this state, the following two conditions (1) and (2) are found as conditions for efficiently collecting the mist 12.

(1) The distance L between the blowing-out opening 7 and the suction opening 8 is almost equal to the distance h between the liquid ejection head 11 and the printing medium 13 as shown in Formula (1) below.

$$L \approx h \qquad \text{Formula (1)}$$

(2) The amount q1 of the gas blown out from the blowing-out opening 7 per unit time is equal to or larger than the amount q2 of the gas sucked into the suction opening 8 per unit time as shown in Formula (2).

$$q1 \geq q2 \qquad \text{Formula (2)}$$

Formula (1) is derived by considering the stability of the gas flow among the blowing-out opening 7, the suction opening 8, and the printing medium 13. More specifically, the stability of the gas flow between the blowing-out opening 7 and the suction opening 8 greatly depends on the aspect ratio of space in which the gas flow is generated. In this example, the aspect ratio of space in which the gas flow is generated so that the mist 12 lands on the printing medium 13 can be defined as L/h. In general, as the aspect ratio becomes larger, the gas flow becomes unstable. Accordingly, it is difficult to collect the mist 12. In this example, in a case where the aspect ratio is about 1, the gas flow becomes the stablest. In the simulation, it is confirmed that Formula (1) is established.

Formula (2) means that in a case where the amount q2 of the sucked gas is larger than the amount q1 of the blown-out gas, part or all of the flow of the gas blown out from the blown-out opening 7 does not reach the printing medium 13. In a case where the gas blown out from the blown-out opening 7 does not reach the printing medium 13, the mist 12 cannot land on the printing medium 13 efficiently. It is confirmed that in this example, in a case where the speed of the gas blown out from the blowing-out opening 7 is about 2 to 5 m/s, Formula (2) is established. The speed of the gas blown out from the blowing-out opening 7 can be set at 5 m/s or less.

Second Embodiment

The direction and angle of an inclination of a portion near an opening portion of the blowing-out opening 7 and the direction and angle of an inclination of a portion near an opening portion of the suction opening 8 are set in various ways as shown in FIGS. 6A, 6B, 6C, and 6D. More specifically, the direction of the gas blown out from the blowing-out opening 7 and the direction of the gas sucked into the suction opening 8 can be set at various angles relative to the surface of the gas blowing-out/suction mechanism 14 parallel to the ejection opening forming surface of the liquid ejection head 11 on which the ejection opening is formed. Further, the speed of the gas blown out from the blowing-out opening 7 and the speed of the gas sucked into the suction opening 8 do not need to be equal and preferably satisfy the condition of Formula (2). Further, a portion between the blowing-out opening 7 and the suction opening 8 does not need to be flat and may be concave or convex. In order to collect the mist 12 more reliably, it is desirable to blow out and suck gas while Formulas (1) and (2) are established.

Third Embodiment

Figure 7A:
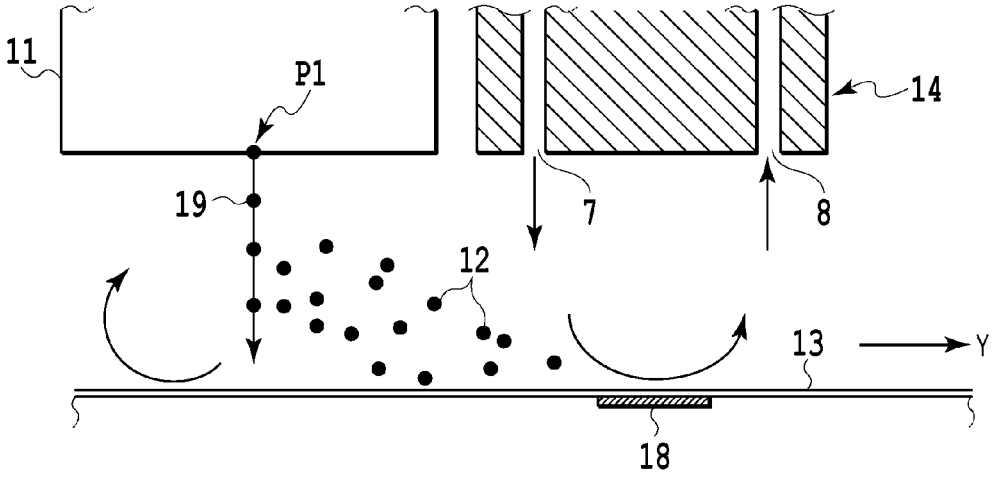
FIGS. 7A and 7B are explanatory views for explaining a relationship between an ink mist and a gas flow in a third embodiment of the present invention.
Figure 7B:
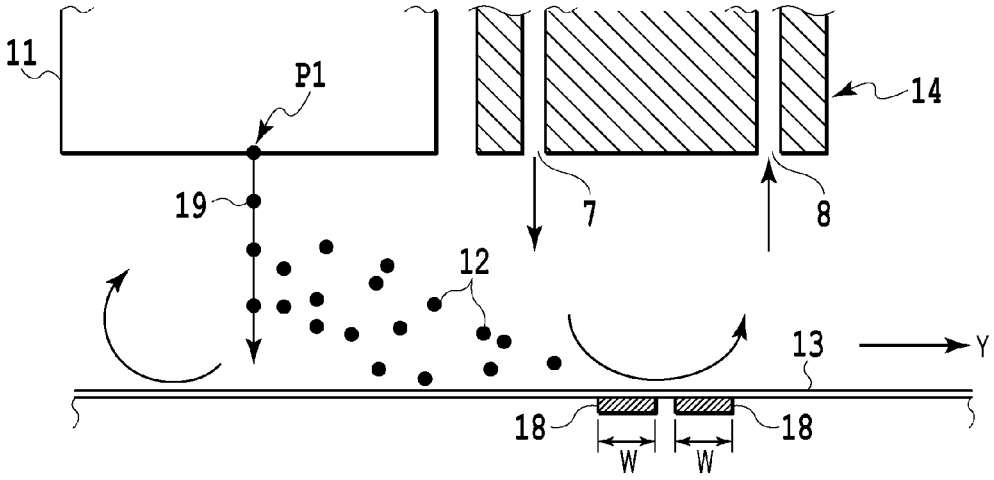

In the present embodiment, an electrode 18 is provided on a lower side (a back side) of the printing medium 13 facing the gas blowing-out/suction mechanism 14 as shown in FIGS. 7A and 7B. As stated above, in a case where gas is blown out from the blowing-out opening 7 and gas is sucked into the suction opening 8, most of the mist 12 can land on the printing medium 13. However, depending on conditions such as the amount of the blown-out gas q1, the amount of the sucked gas q2, the distance L (see FIG. 5), and the distance h (see FIG. 5), the mist 12 may flow downstream in the conveying direction of the arrow Y. The amount of the mist 12 flowing downstream can be kept small by providing the electrode 18 on the back side of the printing medium 13 facing the blowing-out/suction mechanism 14 as shown in FIGS. 7A and 7B.

Normally, the mist 12 is charged negatively. Accordingly, in a case where one electrode 18 is provided as shown in FIG. 7A, it is preferable to use a positive electrode as the electrode 18. However, since some droplets in the mist 12 are charged positively, it is desirable to provide positive and negative electrodes 18 and 18 as shown in FIG. 7B. In FIG. 7B, one of the two electrodes 18 and 18 is a positive electrode and the other is a negative electrode, and these electrodes are displaced from each other in the conveying direction of the arrow Y. One can freely determine which of the two electrodes 18 and which are positioned in the upstream and downstream sides in the conveying direction is to be used as a positive electrode or a negative electrode. In this example, the width W of the electrode 18 in the conveying direction is 0.5 mm. In the case of a full-line type printing apparatus like this example, the length of the electrode 18 in the direction of the width of the printing medium 13 (the front/back direction of a sheet on which FIG. 7 is printed) is close to the width of the printing medium 13.

In a case where the blowing-out opening 7 and the suction opening 8 are not provided and a distance between the liquid ejection head 11 and the printing medium 13 is 1.0 mm, a voltage across the electrode 18 such that all of the mist 12 lands on the printing medium 13 is about 90 to 100 V. In a case where gas is blown out from the blowing-out opening 7 and gas is sucked into the suction opening 8, most of the mist 12 can land on the printing medium 13 even when the voltage across the electrode 18 is V or less. More preferably, the voltage across the electrode 18 is set at 40 V or less, whereby almost all of the mist 12 can land on the printing medium 13. The voltage across the positive and negative electrodes 18 and 18 shown in FIG. 7B can be set within a range of −40 V to +40 V and may be within a range of −4 V to +4 V.

In addition to the blowing-out of gas and the suction of gas, the electrode 18 to which a low voltage is applied is provided on the back surface of the printing medium 13, whereby the mist 12 can land on the printing medium 13 more reliably. In the full-line type printing apparatus like this example, it is preferable to provide the electrode 18 between the blowing-out opening 7 and the suction opening 8 as shown in FIGS. 7A and 7B.

The present invention can be applied to a serial-scan type printing apparatus for printing an image by repeatedly performing an operation for ejecting an ink while moving the liquid ejection head in a main scan direction and an operation for conveying the printing medium in a sub-scan direction crossing the main-scan direction. In this case, the liquid ejection head ejects an ink while moving in the left main scan direction relative to the printing medium in FIGS. 7A and 7B. Further, the electrode 18 is provided on the back surface of the printing medium, extending along the main scan direction, and the length of the electrode 18 needs to be close to the length of a printing area in the main scan direction of the liquid ejection head. In the serial-scan type printing apparatus, in a case where the liquid ejection head is moved in the left main scan direction relative to the printing medium in FIGS. 7A and 7B, the printing medium is moved in the direction of the arrow Y relative to the liquid ejection head.

Fourth Embodiment

Figure 8A:
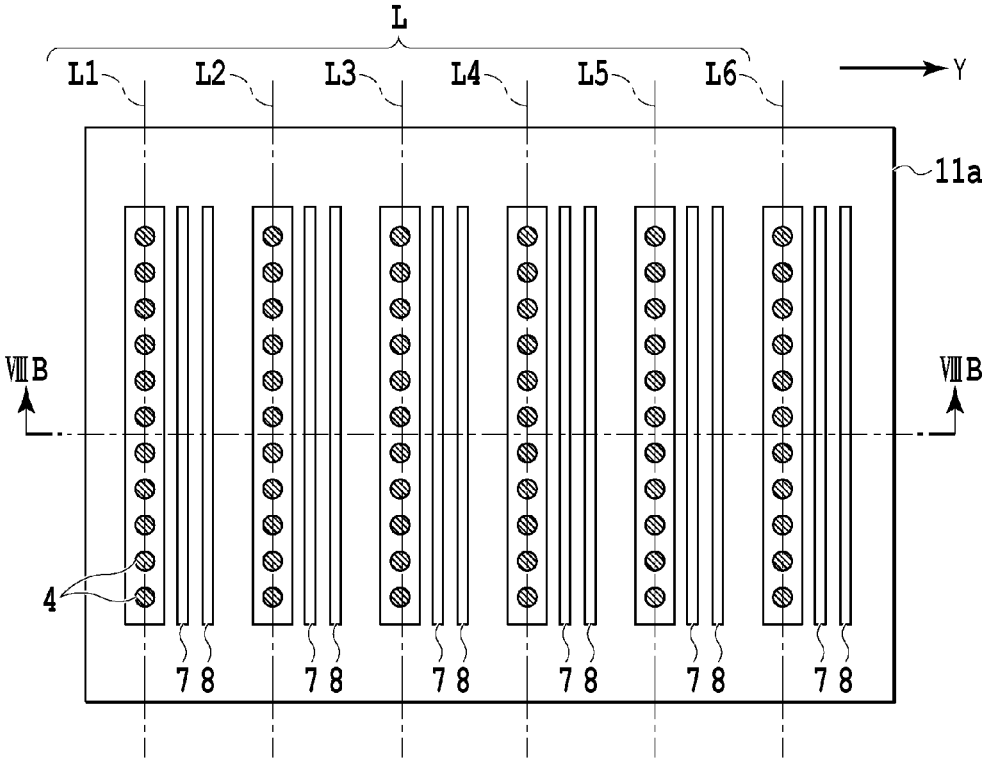
FIG. 8A is an explanatory view for explaining a liquid ejection head in a fourth embodiment of the present invention and FIG. 8B is a cross-sectional view taken along the line VIIIB-VIIIB in FIG. 8A.
Figure 8B:
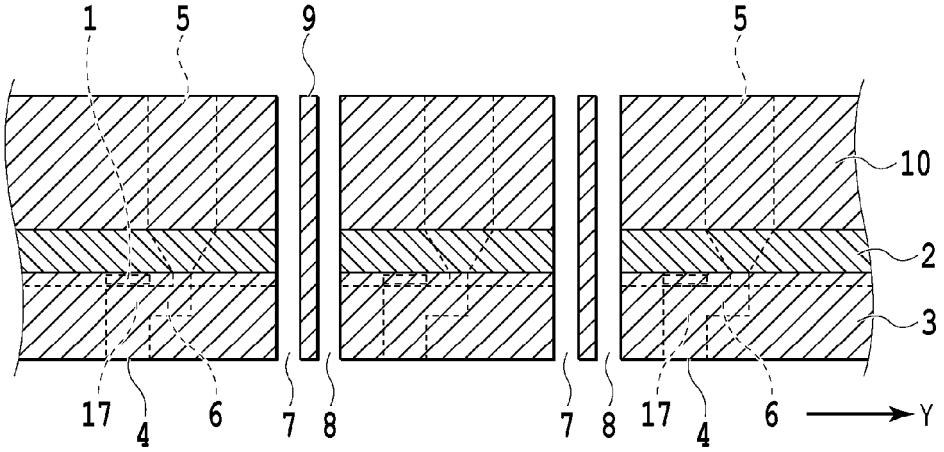

In the present embodiment, a plurality of nozzle arrays L (in this example, six nozzle arrays L1 to L6), and the gas blowing-out opening 7 and the suction opening 8 corresponding to each of the nozzle arrays L are formed in one liquid ejection head 11 as shown in FIGS. 8A and 8B. These nozzle arrays L, the blowing-out opening 7, and the suction opening 8 may be formed in one head chip. The nozzle arrays L may eject different inks or eject the same ink. In the nozzle arrays L, a plurality of nozzles capable of ejecting an ink are arranged, and these nozzles use ejection energy generating elements such as electrothermal transducing elements (heaters) or piezo elements to eject an ink from ejection openings 4 in the ends of the nozzles. In this example, as shown in FIG. 8B, an electrothermal transducing element 1 is used as the ejection energy generating element. The electrothermal transducing element 1 generates heat to bubble an ink supplied from a supply path 5 to a bubbling chamber 17 via a supply chamber 6 and ejects the ink from the ejection opening 4 by using the bubbling energy. The liquid ejection head 11 includes an element substrate 2 on which the electrothermal transducing element 1 is formed, an orifice substrate 3 in which the supply chamber 6 and the bubbling chamber 17 are formed, and a support member 10 in which a supply path 5 is formed.

In a case where the liquid ejection head 11 in this example is applied to a full-line type printing apparatus, the printing medium is conveyed in the direction of the arrow Y relative to the liquid ejection head 11. Further, in a case where the liquid ejection head 11 in this example is applied to a serial-scan type printing apparatus, the liquid ejection head 11 ejects an ink while moving in the left main scan direction in FIGS. 8A and 8B. In this manner, even in a case where the liquid ejection head 11 moves in the main scan direction, the printing medium moves relatively in the direction of the arrow Y with respect to the liquid ejection head 11.

Fifth Embodiment

FIGS. 9A, 9B, 9C, 10A, and 10B are explanatory views for explaining different structural examples of the blowing-out section 15 and the suction section 16 (see FIG. 2B) connected to the blowing-out opening 7 and the suction opening 8.

Figure 9A:
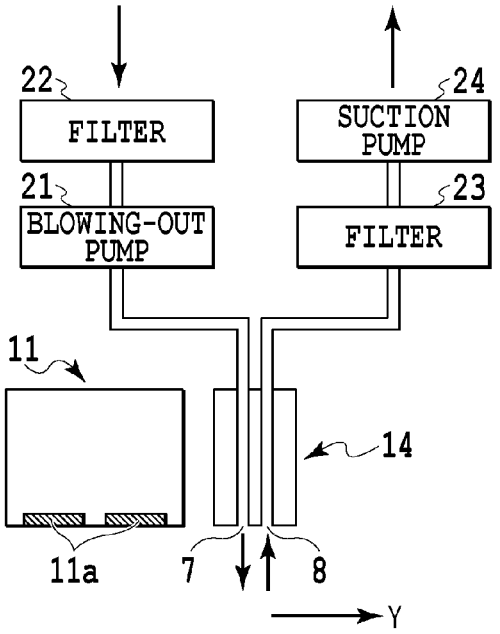
FIGS. 9A, 9B, and 9C are schematic views for explaining different structural examples of a blowing-out section and a suction section as a fifth embodiment of the present invention.

In a case where in the full-line type printing apparatus, a plurality of the long liquid ejection heads 11 are arranged in the conveying direction of the printing medium (the direction of the arrow Y), each liquid ejection head 11 is provided with the blowing-out/suction mechanism 14 as shown in FIG. 9A. In the liquid ejection head 11 in this example, the head chips 11*a* in which the nozzles are formed are arranged in a zigzag pattern as shown in FIG. 3. In FIG. 9A, a blowing-out pump 21 and a filter 22 are provided for the blowing-out opening 7, and the blowing-out pump 21 blows out, from the blowing-out opening 7, external air (gas) introduced through the filter 22. Further, a filter 23 and a suction pump 24 are provided for the suction opening 8, and the suction pump 24 externally discharges air (gas) sucked into the suction opening 8 through the filter 23.

Figure 9B:
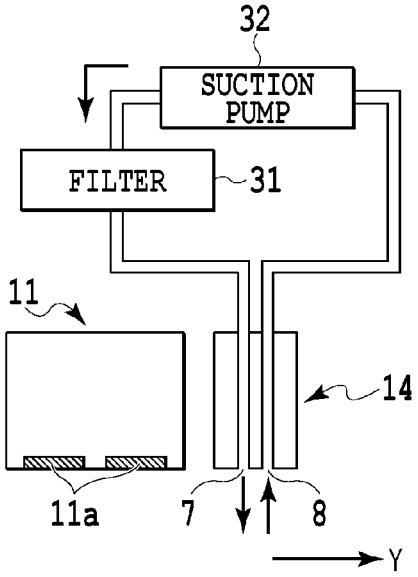

In FIG. 9B, air sucked into the suction opening 8 by one suction pump 32 is blown out from the blowing-out opening 7 through the filter 31. In this case, the amount of air blown out from the blowing-out opening 7 per unit time is equal to the amount of air sucked into the suction opening 8 per unit time.

Figure 9C:
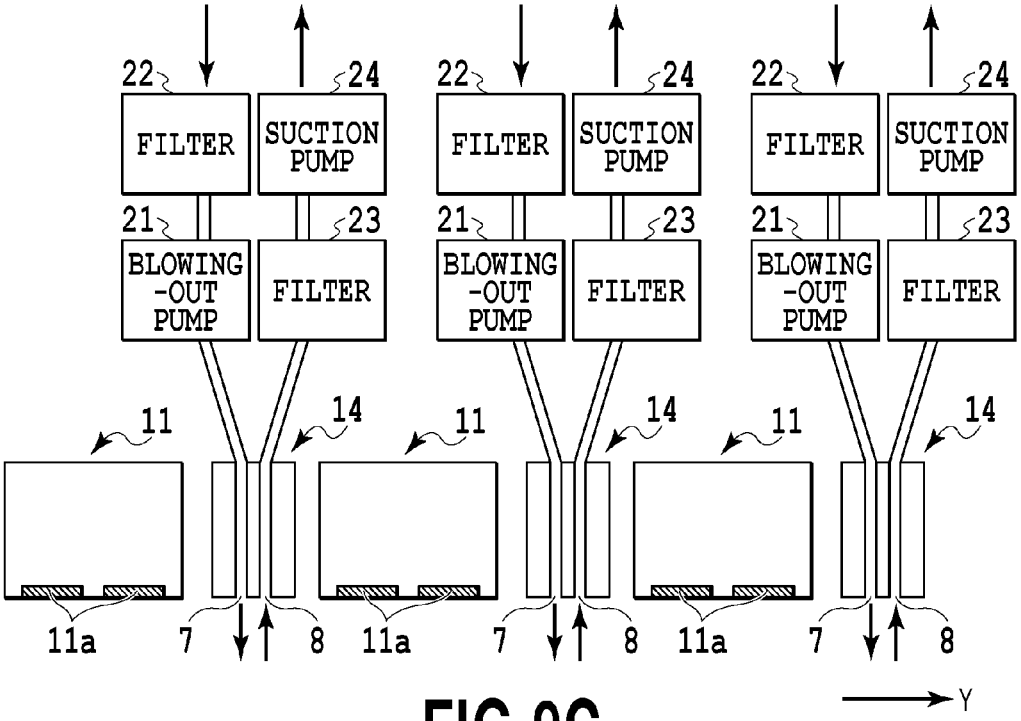
Figure 10A:
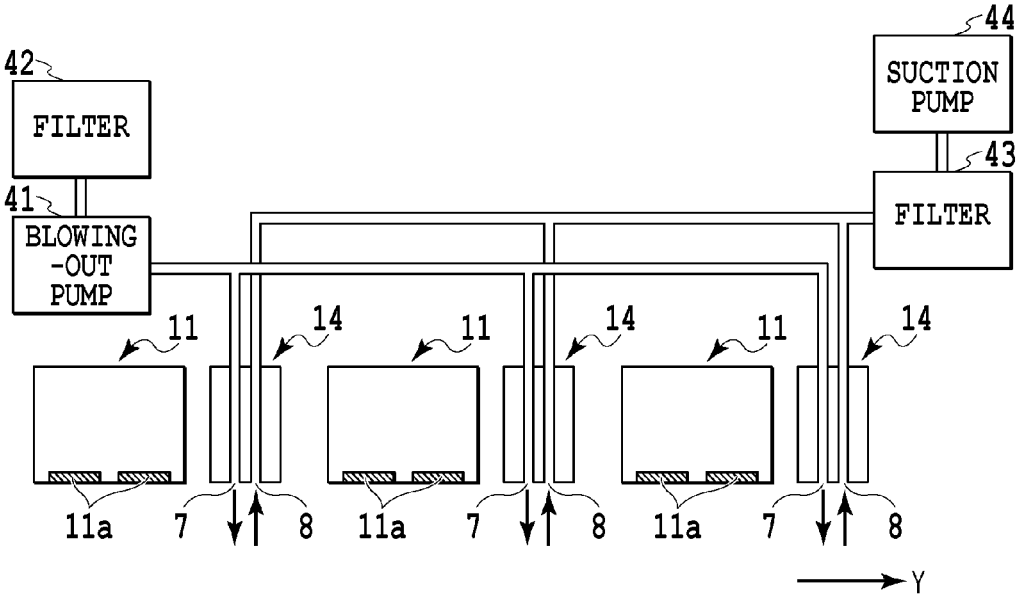
FIGS. 10A and 10B are schematic views for explaining different structural examples of the blowing-out section and the suction section as the fifth embodiment of the present invention.

In FIG. 9C, the plurality of liquid ejection heads 11 are arranged in the conveying direction of the printing medium (the direction of the arrow Y), and each liquid ejection head 11 is provided with the blowing-out/suction mechanism 14. Each mechanism 14 includes the blowing-out pump 21, the filter 22, the suction pump 24, and the filter 23 like the mechanism shown in FIG. 9A. In FIG. 10A, a common blowing-out pump 41 and a common filter are provided for the blowing-out openings 7 of the plurality of blowing-out/suction mechanisms 14, and a common suction pump 44 and a common filter 43 are provided for the suction openings 8 of the plurality of blowing-out/suction mechanisms 14.

Figure 10B:
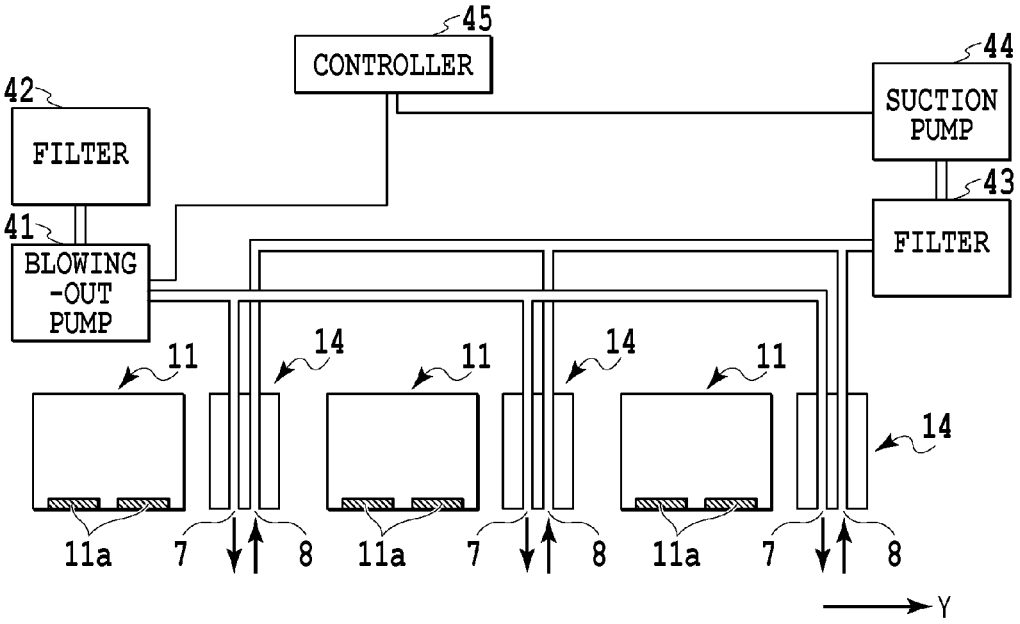

In FIG. 10B, a controller 45 controls the blowing-out pump 41 and the suction pump 44 shown in FIG. 10A based on a printing duty corresponding to the amount of an ink applied to a unit area of the printing medium. In a case where the printing duty is high, that is, in a case where the amount of the ink applied to the unit printing area is large, the blowing-out pump 41 and the suction pump 44 can be controlled so that the amount of air blown out from the blowing-out opening 7 and the amount of air sucked into the suction opening 8 are large. On the other hand, in a case where the printing duty is low, that is, in a case where the amount of the ink applied to the unit printing area is small, the blowing-out pump 41 and the suction pump 44 can be controlled so that the amount of air blown out from the blowing-out opening 7 and the amount of air sucked into the suction opening 8 are small. Further, in a case where an electrode 18 is provided as shown in FIGS. 7A and 7B, the controller 45 can control a voltage to be applied to the electrode 18 according to the printing duty. In this case, when the printing duty is high, the voltage to be applied to the electrode can be set to be high, and when the printing duty is low, the voltage to be applied to the electrode 18 can be set to be low.

Further, as described above, most of the mist lands on the printing medium and the amount of the mist included in air sucked into the suction opening 8 is small. Accordingly, it is possible to use simple filters as the filters shown in FIGS. 9A, 9B, 9C, 10A, and 10B. Further, since these filters do not have many stains, maintenance is unnecessary for a long time. Furthermore, since an apparatus for externally discharging a mist is also unnecessary, it is possible to miniaturize the printing apparatus as a whole.

Sixth Embodiment

Figure 11:
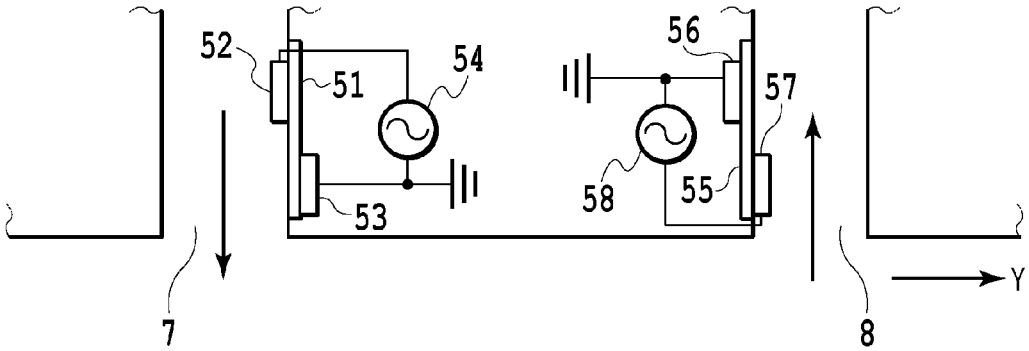
FIG. 11 is a schematic view for explaining a blowing-out section and a suction section in a sixth embodiment of the present invention.

In the present embodiment, as shown in FIG. 11, a plasma actuator including a dielectric and an AC power source is used to blow out gas from the blowing-out opening 7 and suck gas into the suction opening 8. A gas flow blown out from the blowing-out opening 7 is generated by applying an AC voltage from an AC power source 54 to electrodes 52 and 53 between which a dielectric 51 provided in the blowing-out opening 7 is sandwiched. Further, a gas flow sucked into the suction opening 8 is generated by applying an AC voltage from the AC power source 58 to electrodes 56 and 57 between which a dielectric 55 provided in the suction opening 8 is sandwiched. Use of the above plasma actuator makes it possible to generate a gas flow even in small space, to make unnecessary large equipment such as a pump, and to miniaturize the printing apparatus as a whole.

Other Embodiments

The present invention can be applied to a liquid ejection apparatus (including an inkjet apparatus) which uses the liquid ejection head capable of ejecting a liquid to subject various media (including sheets and the like) to various processes (printing, processing, application, irradiation, reading, examination, and the like). The medium (including the printing medium) includes various media for which any material such as paper, plastic, a film, a woven fabric, metal, or a flexible substrate can be used as long as a liquid including an ink can be applied to the media.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-062313, filed Mar. 25, 2014 and No. 2014-262526, filed Dec. 25, 2014 hereby incorporated by reference wherein in their entirety.

What is claimed is:

1. A liquid ejection apparatus comprising:

a plurality of liquid ejection heads arranged in parallel, each of the liquid ejection heads having an ejection opening from which a liquid is ejected to a medium during relative movement between the liquid ejection head and the medium;

at least one blowing-out unit communicating with a plurality of blowing-out openings facing the medium so as to blow out gas toward the medium, the plurality of blowing-out openings corresponding to the plurality of the liquid ejection heads and being relatively fixed to the corresponding liquid ejection heads with respect to a movement direction of the medium; and at least one suction unit communicating with a plurality of suction openings for sucking gas on the medium, the plurality of suction openings corresponding to the plurality of the liquid ejection heads and being relatively fixed to the corresponding liquid ejection heads with respect to the movement direction of the medium, wherein each blowing-out opening and each suction opening are provided for each of the corresponding liquid ejection heads, wherein each ejection opening, each blowing-out opening, and each suction opening are arranged, regarding each of the corresponding liquid ejection heads, in order from an upstream side to a downstream side in the movement direction of the medium with respect to the liquid ejection head, and wherein, regarding each of the corresponding liquid ejection heads, the amount of gas blown out from each blowing-out opening per unit time is larger than the amount of gas sucked into each suction opening per unit time.

2. The liquid ejection apparatus according to claim 1, wherein a speed of gas blown out from the blowing-out openings is 5 m/s or less.

3. The liquid ejection apparatus according to claim 1, further comprising an electrode to which a voltage is to be applied and which is positioned below the medium and between at least one of the blowing-out openings and a corresponding one of the suction openings in the movement direction of the medium.

4. The liquid ejection apparatus according to claim 3, wherein the voltage to be applied to the electrode is 40 V or less.

5. The liquid ejection apparatus according to claim 3, wherein the voltage to be applied to the electrode is 4 V or less.

6. The liquid ejection apparatus according to claim 3, wherein the electrode includes a positive electrode and a negative electrode.

7. The liquid ejection apparatus according to claim 6, wherein a voltage to be applied to the positive electrode and the negative electrode is between −40 V and +40 V.

8. The liquid ejection apparatus according to claim 6, wherein a voltage to be applied to the positive electrode and the negative electrode is between −4 V and +4 V.

9. The liquid ejection apparatus according to claim 1, wherein at least one of the blowing-out unit and the suction unit generates a gas flow by using a plasma actuator including an AC power source and a dielectric.

10. The liquid ejection apparatus according to claim 1, wherein each liquid ejection head has a length corresponding to a width of the medium.

11. The liquid ejection apparatus according to claim 1, wherein the blowing-out unit and the suction unit have a length corresponding to a width of the medium.

* * * * *